United States Patent [19]

Caruthers

[11] Patent Number: 4,896,880

[45] Date of Patent: Jan. 30, 1990

[54] EXERCISE DEVICES

[75] Inventor: Scott Caruthers, Glen Burnie, Md.

[73] Assignee: Dar Products Corporation, Baltimore, Md.

[21] Appl. No.: 241,297

[22] Filed: Sep. 9, 1988

Related U.S. Application Data

[63] Continuation-in-part of Ser. No. 94,794, Sep. 14, 1987, Pat. No. 4,813,669.

[51] Int. Cl.[4] ..... A63B 11/00

[52] U.S. Cl. ..... 272/122; 272/119; 272/123; 272/117

[58] Field of Search ..... 272/122, 123, 117, 119, 272/124; D21/197, 198

[56] References Cited

U.S. PATENT DOCUMENTS

| | | | |
|---|---|---|---|
| D. 26,418 | 12/1896 | Heydrick | 272/124 |
| 113,966 | 4/1871 | Ballou | 272/122 |
| D. 197,726 | 3/1964 | James, Jr. | 272/123 |
| D. 197,899 | 4/1964 | Sutcliffe | D21/197 |
| D. 203,052 | 11/1965 | Erhard | D21/197 |
| D. 203,837 | 2/1966 | James, Jr. | 272/123 |
| D. 215,057 | 8/1969 | Sun | 272/122 |
| D. 216,517 | 1/1970 | Dorn | D21/197 |
| D. 223,843 | 6/1972 | Li | D21/197 |
| D. 242,865 | 12/1976 | Stamm | D21/197 |
| D. 244,628 | 6/1977 | Wright | D21/197 |
| D. 244,629 | 6/1977 | Wright | D21/197 |
| 259,752 | 6/1882 | Fisher | 272/122 |
| D. 264,625 | 5/1982 | Shiu | D21/197 |
| D. 267,737 | 1/1988 | Wright | D21/197 |
| D. 268,437 | 3/1988 | Giordano | D21/197 |
| D. 271,408 | 11/1988 | Bauer | D21/197 |
| D. 273,030 | 3/1984 | Anderson | D21/197 |
| D. 274,283 | 6/1984 | Wright | D21/197 |
| 654,097 | 7/1900 | Sandow | 272/122 |
| 714,463 | 11/1902 | Duffner | 128/25 R |
| 1,229,658 | 6/1917 | Sandow | 272/122 |
| 1,316,683 | 9/1919 | Calvert | 272/122 |
| 1,749,632 | 3/1930 | Ferris | 272/122 |
| 1,918,142 | 7/1933 | Smith | 272/122 |
| 3,231,270 | 1/1966 | Winer | 272/123 |
| 3,747,593 | 7/1973 | Taylor | 128/26 |
| 4,029,312 | 6/1977 | Wright | 272/123 |
| 4,361,324 | 11/1982 | Baroi | 272/123 |
| 4,627,618 | 12/1986 | Schwartz | 272/122 |
| 4,695,051 | 9/1987 | Jenison | 272/122 |

OTHER PUBLICATIONS

Promotional literature on "Space Weights", by Grafar.

*Primary Examiner*—Richard J. Apley
*Assistant Examiner*—J. Welsh
*Attorney, Agent, or Firm*—Leonard Bloom

[57] ABSTRACT

An exercise device is intended for strengthening a user's targeted muscle, wherein the user may manipulate the device without the necessity of a forceful grip that employs the user's conjunctive muscles. The device includes a housing having a pair of diametrically-opposed portions (preferably hemispherical) each of which has a peripheral edge. The peripheral edges are formed so as to provide a solid mating relationship therebetween. A single weight structure is disposed in the housing, and the weight structure has a pair of opposite ends, each of which is secured to a respective diametrically opposed portion of the housing.

30 Claims, 15 Drawing Sheets

EXERCISE DEVICES

CROSS-REFERENCE TO RELATED APPLICATION

The present application is a continuation-in-part of application Ser. No. 094,794 filed Sept. 14, 1987, now U.S. Pat. No. 4,813,669 the disclosure of which is incorporated in its entirety by reference herein.

FIELD OF THE INVENTION

The present invention relates to exercise devices, and more particularly, to exercise devices intended for the accelerated development and strengthening of a user's targeted muscle or muscles, as well as a method for the assembly and production of the exercise devices.

BACKGROUND OF THE INVENTION

The use of specialized equipment and various mechanical apparatuses for strengthening muscles is well known. Moreover, the desirability of providing a device which is capable of isolating and developing a specifically targeted muscle, one of the most common of which is the bicep, has also been long recognized.

However, one of the most troublesome problems presented with providing a device that can isolate and fully develop a muscle, such as the bicep, is that any sort of gripping and grasping action with the hand automatically employs the conjunctive muscles of the arm, including the forearm, tricep and deltoid. The same problem is encountered for the exercise and strengthening of other muscles in the body.

Unfortunately, each of the apparatuses and devices resorted to in the prior art for developing a specifically targeted muscle, such as the bicep, provide for some sort of handle which must be gripped and/or grasped by the user thereof. Examples of these devices are enumerated as follows:

| Inventor(s) | Pat. No. | Year Issued |
|---|---|---|
| Fisher | 259,752 | 1882 |
| Heydrick | D 26,418 | 1896 |
| Sandow | 654,097 | 1900 |
| Duffner | 714,463 | 1902 |
| Sandow | 1,229,658 | 1917 |
| Calvert | 1,316,683 | 1919 |
| Ferris | 1,749,632 | 1930 |
| Smith | 1,918,142 | 1933 |
| Winer | 3,231,270 | 1966 |
| Sun | D 215,057 | 1969 |
| Collins, Jr. et al | D 221,874 | 1971 |
| Li | D 223,843 | 1972 |
| Stamm | D 242,865 | 1976 |
| Wright | D 244,628 | 1977 |
| Wright | D 244,629 | 1977 |
| Wright | 4,029,312 | 1977 |
| Shin | D 264,625 | 1982 |
| Baroi | 4,361,324 | 1982 |
| Wright | D 267,737 | 1983 |
| Giordano | D 268,437 | 1983 |
| Anderson | D 273,030 | 1984 |
| Wright | D 274,283 | 1984 |
| Schwartz | 4,627,618 | 1986 |
| Jenison | 4,695,051 | 1987. |

This gripping and/or grasping action required by each of these devices is a definite disadvantage, since it involves the use of conjunctive muscles which prevents isolation required for the total development of the targeted muscle.

More specifically, every piece of exercise equipment or mechanical apparatus heretofore resorted to in the prior art invariably contains one common detractive denominator inherent within its design. Whatever else is intended—whether barbell, dumbbell, or one of the various exercise machines designed for total fitness—there exists some sort of handle which must be grasped in order to use the device. Quite clearly, one must hold onto a handle to make the device work. This action of holding the handle automatically and necessarily employs the conjunctive (adjoining) muscles. Such "helper" muscles actually take away from the isolation required for full development of any specifically targeted muscle.

This detractive denominator occurs because of the physiological structure of the human body. A precise interface of cardiovascular, neural-nervous system, respiratory, and muscular function is adequate to carry the average person through their normal daily activity. However, this interface is simply not sufficient to create an above average (or dynamic) physique. Combined with the time constraints that typically discourage regular exercise, the obvious result is a rather large population group composed of "ordinary" (somewhat less than splendidly developed) individuals.

In said U.S. patent application Ser. No. 094,794 filed Sept. 14, 1987, the inventors disclosed an exercising device which an individual can utilize and manipulate without the necessity of grasping. In this device, weights and fillers are disposed in a casing having a constant outer diameter (O.D.). The ratio of weights to fillers is varied for varying the weight of the device. The weight casing is housed in a housing which includes a pair of body portions that are joined together by a keying means. The keying means includes an arcuate rib which is formed on the peripheral edge of each of the body portions and which mates with one another when the body portions are bought together. Thereafter, the peripheral edges are glued, ultrasonically welded or otherwise integrally joined.

While successfully providing a device which may be manipulated without grasping, this device can be improved on by providing better and easier access to the weights, so that they may be changed or selectively varied, as desired. Additionally, it would be further advantageous to provide a weight means that eliminates a substantial portion of the weights and/or fillers which are needed and which are readily subject to being lost. Finally, it would be further advantageous to provide such a weight means that is not subject to shifting during the use thereof.

Accordingly, it will be appreciated that there remains a need for an exercise device for strengthening a user's targeted muscle; wherein the device is capable of being utilized by the user, such that a forceful grip is not required by the user; and wherein the necessity for employing the user's conjunctive adjoining muscles is substantially reduced, thereby substantially reducing the tendency to detract from the development of the user's targeted muscle, wherein the body portions thereof are formed so as to be readily separable, so as to provide access to the weights disposed therein, and wherein only one weight is utilized at a time without the need of fillers, which is not capable of shifting during use thereof.

SUMMARY OF THE INVENTION

Accordingly, it is an object of the present invention to provide an exercise device for strengthening a user's targeted muscle which is capable of being utilized by the user thereof, such that the necessity for employing the user's conjunctive adjoining muscles is substantially reduced, thereby substantially reducing the tendency to detract from the development of the user's targeted muscle.

While not limited thereto, it is another object of the present invention to provide such an exercise device for strengthening a user's targeted muscles, including the abdominal region and extending thereabove, such as the biceps, triceps, forearm, deltoids and the pectoral muscles.

It is yet another object of the present invention to isolate the development of a targeted muscle by substantially eliminating the normal requirement for using the adjoining conjunctive muscles, thereby substantially improving the development of the targeted muscle.

It is still yet another object of the present invention to provide such a weight training device which provides ready access to the weights disposed therein for selectively changing the weight of, and the resistance provided by, the device.

It is a yet further object of the present invention to provide such a weight training device, wherein one weight is utilized for each desired resistance, and that is not subject to any slippage, sliding or shifting movement whatsoever during the use thereof.

The devices of the present invention, by virtue of their unique configuration, virtually eliminate the assistance of conjunctive muscles during the performance of many regimen exercises. Consequently, the effect translates as an achievement ratio of approximately 3.5 to 1. This is accomplished in a manner unparalleled in the physical fitness field.

More specifically, the user is not required to grasp the device of the present invention. Rather, the device simply cradles the user's hand, and the device is so designed that the user's hand remains at all times in a comfortable and natural "at rest" position. The device of the present invention cannot be grasped by a handle, because there is no handle to grasp. As a result, there is an accelerated rate of achievement, and less time is spent on exercise while deriving full benefit.

In a preferred embodiment, a device of the present invention weighing ten (10) pounds, when properly employed, has a beneficial effect roughly equivalent to the employment of a conventional thirty-five (35) pound weight heretofore resorted to in the prior art.

It is a still further object of the present invention to provide a method of forming the exercise devices of the present invention.

In accordance with the teachings of the present invention, there is disclosed herein an exercise device that has a housing having a weight means disposed therein. The housing further has an opening formed therein substantially tangentially of the housing. The opening is bounded by a relatively-thin outer wall and an inner wall having respective convex and concave portions. The hand of the user may be inserted through the opening in the housing, such that the user's hand is disposed between the inner and outer walls, such that the palm of the user's hand rests substantially on the convex portion of the inner wall, and such that the heel of the user's hand rests substantially on the concave portion of the inner wall. In this manner, a forceful grip is not required by the user, and the necessity for employing the user's conjunctive adjoining muscles is substantially reduced, thereby substantially reducing the tendency to detract from the development of the user's targeted muscle. Finally, the weight means has a pair of opposite ends; and each of the opposite ends is joined to a respective diametrically opposed portion of the housing.

Preferably, the housing includes a pair of complementary housing portions. The housing portions have respective peripheral edges along which the housing portions mate. Each of the housing portions also have one of the diametrically opposed portions of the housing to which one of the respective opposite ends of the weight means is joined. Means is provided for securing each of the opposite ends of the weight means to a respective diametrically opposed portion of the housing. In this manner, the peripheral edges of the housing portions mate with one another, forming an integral housing.

It is further preferred that the peripheral edge of one of the housing portions has a tongue formed thereon. Also the peripheral edge of the other of the housing portions has a groove formed therein to receive the tongue in a mating relationship. In this manner, the peripheral edges of the housing portions mate with one another.

In a still further preferred embodiment, the means for securing each of the opposite ends of the weight means to a respective diametrically opposed portion of the housing includes a pair of cap screws. Each cap screw is removably disposed through a respective housing portion and received in a respective opposite end of the weight means. In this manner, the housing portions are removably secured to the respective opposite ends of the weight means, with the peripheral edges of the housing portions in a mating relationship. In this respect, it is further preferred for each of the opposite ends of the weight means to have a blind axial bore formed therein for receiving one of the respective cap screws therein.

In accordance with the further teachings of the present invention, there is disclosed a housing that includes complementary housing halves. Each of these housing halves is relatively thin-walled. The housing halves have respective peripheral edges that are mated together along a common midplane between the housing halves. A weight means is disposed within the housing. The weight means has a pair of opposite ends; and means are provided for securing each of the housing halves to a respective opposite end of the weight means. In this manner, the housing halves are secured to one another having the respective peripheral edges mated together along the common midplane. The housing has an opening formed therein substantially tangentially of the housing. In this manner, the hand of the user may be inserted through the opening in the housing and at least partially around the weight means radially thereof. The user's hand is further disposed at least partially between the weight means and the wall of the housing, such that a forceful grip is not required by the user, and such that the necessity for employing the user's conjunctive adjoining muscles is substantially reduced. Thus, the tendency to detract from the development of the user's targeted muscle is substantially reduced.

Viewed in another aspect, the present invention provides an exercise device including a housing having a pair of complementary mating portions formed with peripheral edges mating along a common midplane. A weight is disposed between the mating housing portions substantially transversely of the common midplane therebetween. Means are provided for securing the housing portions and the weight together to thereby form a unitary article. The housing has a substantially tangential opening formed therein to receive the user's hand, such that the palm of the user's hand substantially confronts and is cradled around the weight, and such that the back of the user's hand substantially confronts an inner walled surface of the housing. In this manner, a forceful grip by the user's hand on the weight is not necessary; and the necessity for employing the user's conjunctive adjoining muscles is substantially reduced, thereof substantially reducing the tendency to extract from the development of the user's targeted muscle.

Viewed in yet another aspect, the present invention provides an exercise device having an opening formed therein through which the hand of the user may be inserted. This opening is defined by a pair of walls in the device, including an inner wall and an outer wall, such that the user's hand is substantially curved around the inner wall and is disposed between the inner and outer walls, respectively. An internal wall within the device limits the insertion of the user's hand through the opening. A weight means is disposed substantially centrally of the device and within the inner wall thereof, such that a forceful grip of the user's hand on the weight means is not necessary, and such that the necessity for employing the user's conjunctive adjoining muscles is substantially reduced, thereby substantially reducing the tendency to detract from the development of the user's targeted muscle.

Preferably, the inner wall has a convex outer surface; the outer wall has a concave inner surface and is disposed radially of the inner wall; and the internal wall comprises a radial wall joining the inner and outer walls beyond the opening in the device.

In a preferred embodiment, the exercise device is substantially spherical, and the opening is formed therein substantially tangentially thereof.

Viewed in yet still another aspect of the present invention, a method is disclosed for forming an exercise device intended for strengthening a user's target muscle. This method includes the steps of forming a pair of substantially hemispherical, relatively thin-walled housing portions. At least one of the housing portions has a cut-away portion, and each of the housing portions has a peripheral edge and a diametrically-opposed portion. A weight means is provided having a pair of opposed ends, and a pair of cap screws are provided. Each opposed end of the weight means is secured to a respective diametrically-opposed portion of each of the housing portions by one of the respective cap screws. In this manner, each opposed end of the cylinder is supported thereby; and the peripheral edges mate with one another, whereby the housing further has an opening formed therein substantially tangentially of the housing and communicating with the cut-away portion thereof.

These and other objects of the present invention will become apparent from a reading of the following specification, taken in conjunction with the enclosed drawings.

BRIEF DESCRIPTION OF THE DRAWINGS

FIG. 12 is a side elevation of the body portion of the casing for the weight means, wherein the body portion is folded into a substantially flat shape for shipment.

FIG. 13 is an end view of the body portion of FIG. 12.

FIG. 14 is a side elevation of the body portion of the casing, wherein the body portion is unfolded into a substantially cylindrical shape for use thereof during manufacture of the exercise device.

FIG. 15 is an end view of the unfolded cylindrical body portion, corresponding substantially to FIG. 14.

FIG. 16 is a perspective view of the cylindrical body portion with a cap inserted on one end thereof and further with weights being disposed therein.

FIG. 17 is a further perspective view of the cylindrical body portion having all the weights disposed therein, further showing the insertion of a cap on the other end thereof.

FIG. 18 is a perspective view of the cylindrical weight means being disposed in the respective concave inner recess of one of the hemispherical housing portions.

FIG. 19 is another perspective view of the other of the hemispherical housing portions, shown partially disposed over the other of the opposed ends of the cylindrical weight means.

FIG. 20 is still another perspective view, showing the hemispherical housing portions being assembled and almost completely covering the cylindrical weight means.

DESCRIPTION OF PREFERRED EMBODIMENTS

Figure 1:
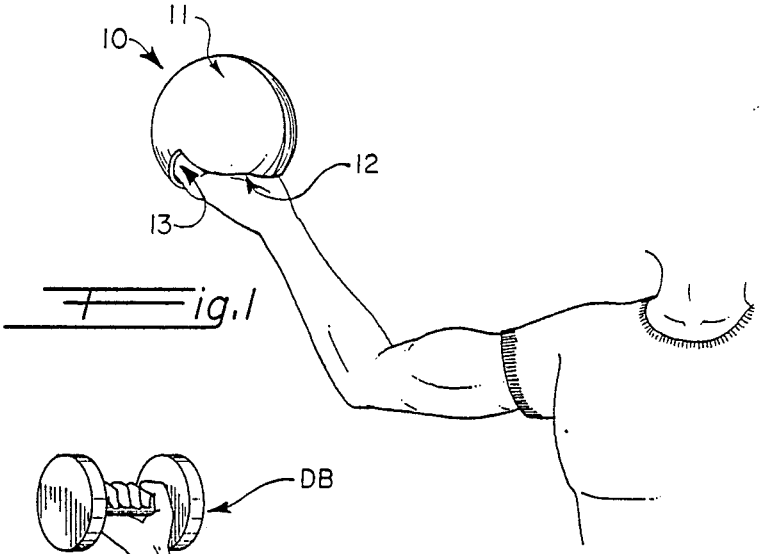
FIG. 1 is a pictorial view of the exercise device of the present invention, illustrating one use of the device for strengthening the user's targeted muscle which, in this case, is the bicep.

With reference to FIG. 1, there is illustrated the exercise device 10 of the present invention for strengthening one of the user's targeted muscles (in this case, the bicep) such that a forceful grip is not required by the user. Such an arrangement substantially eliminates the necessity for employing the user's conjunctive muscles adjoining the bicep. In this manner, the tendency to detract from the development of the user's targeted bicep muscle is substantially reduced.

Figure 1A:
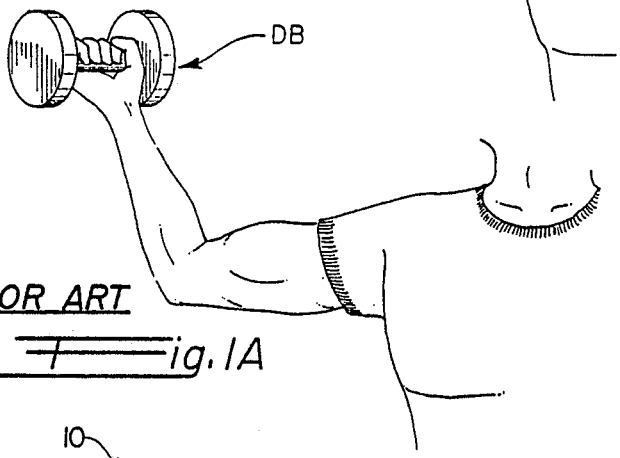
PRIOR ART Fig. 1A
FIG. 1A is a pictorial view of a conventional prior art dumbbell, illustrating its normal use.

By comparison, and with reference to FIG. 1A, there is illustrated the use of a conventional dumbbell DB for strengthening the user's targeted muscle (again, in this case, the bicep). In using these conventional devices, such as a dumbbell, the user must forcefully grip the handle of the dumbbell. This gripping action has the tendency to detract from the development of the user's targeted bicep muscle, thereby substantially reducing the efficiency of the device.

The same concept is equally applicable to other targeted muscles, besides the bicep, consonant with the teachings of the present invention.

Figure 2:
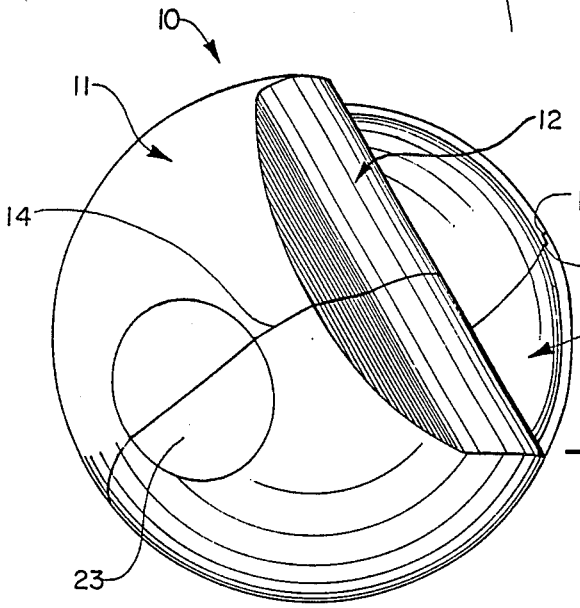
FIG. 2 is a perspective view of a preferred embodiment of the exercise device of the present invention.
Figure 3:
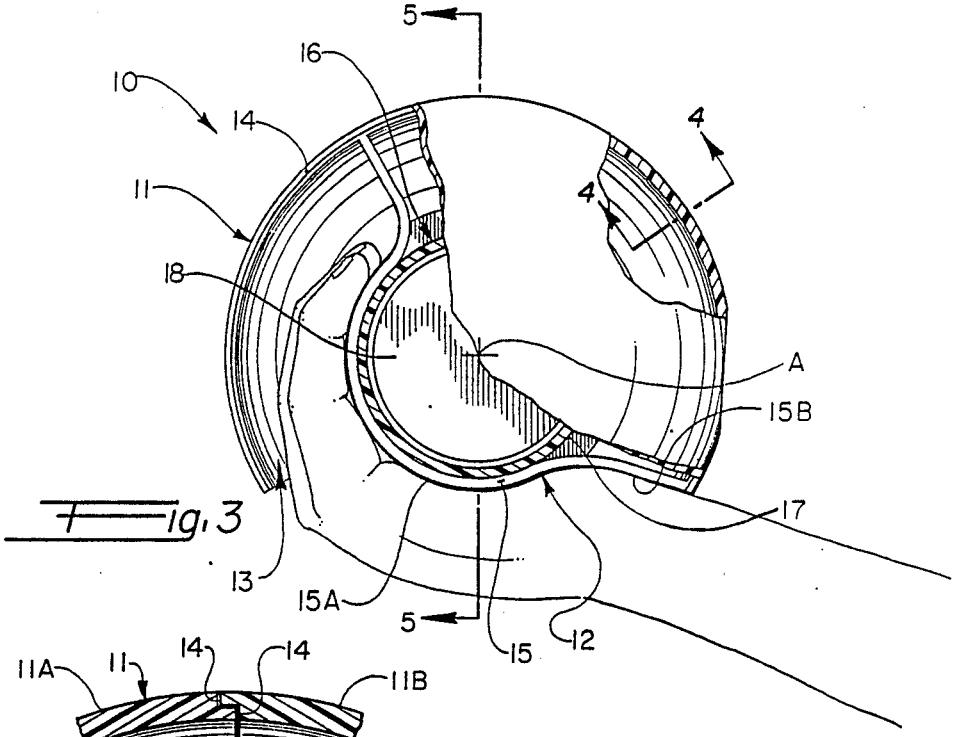
FIG. 3 is a side elevational view of the exercise device, with parts thereof broken away and sectioned, to show the positioning of the user's hand therein between the relatively thin-walled housing and the cylindrical weight means mounted in the housing.
Figure 4:
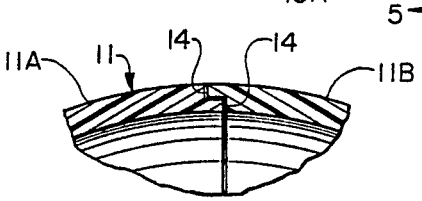
FIG. 4 is a section view, taken along lines 4—4 of FIG. 3 and drawn to an enlarged scale, and showing the arcuate ribs between the complementary relatively thin-walled hemispherical housing portions.
Figure 5:
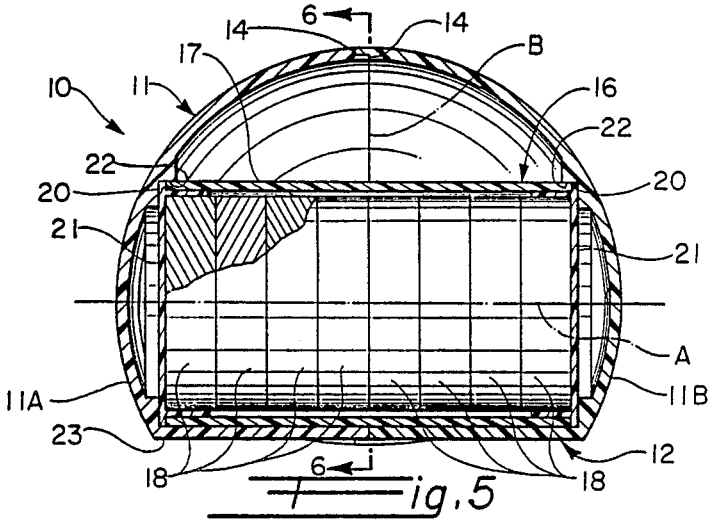
FIG. 5 is a section view, taken along lines 5—5 of FIG. 2, and showing the manner in which the cylindrical weight means is mounted between the complementary housing portions.
Figure 7:
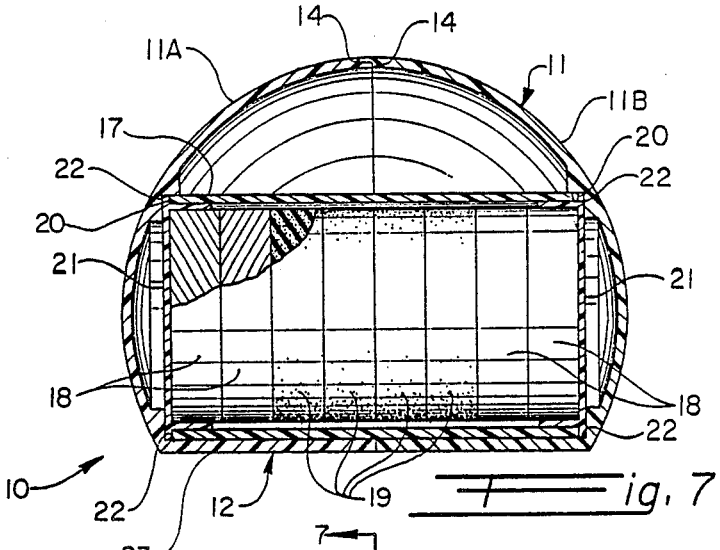
FIG. 7 is another section view, corresponding substantially to FIG. 5, but showing several "filler" or "dummy" weights disposed in the cylinder.
Figure 6:
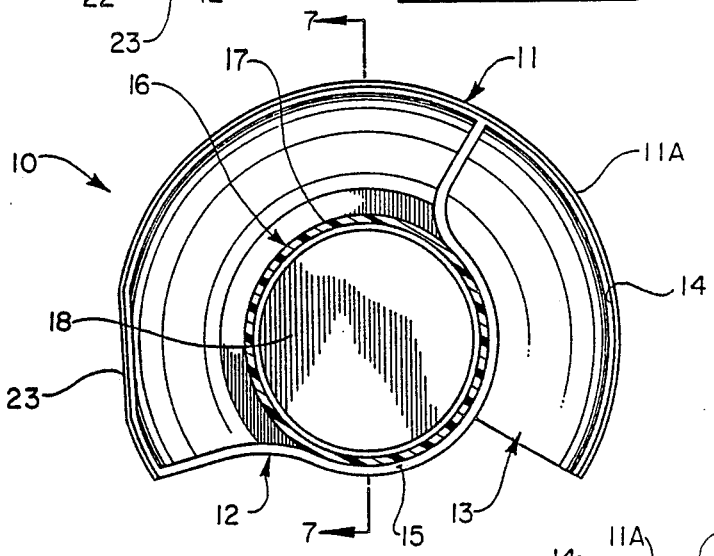
FIG. 6 is a section view, taken along lines 6—6 of FIG. 5.
Figure 8:
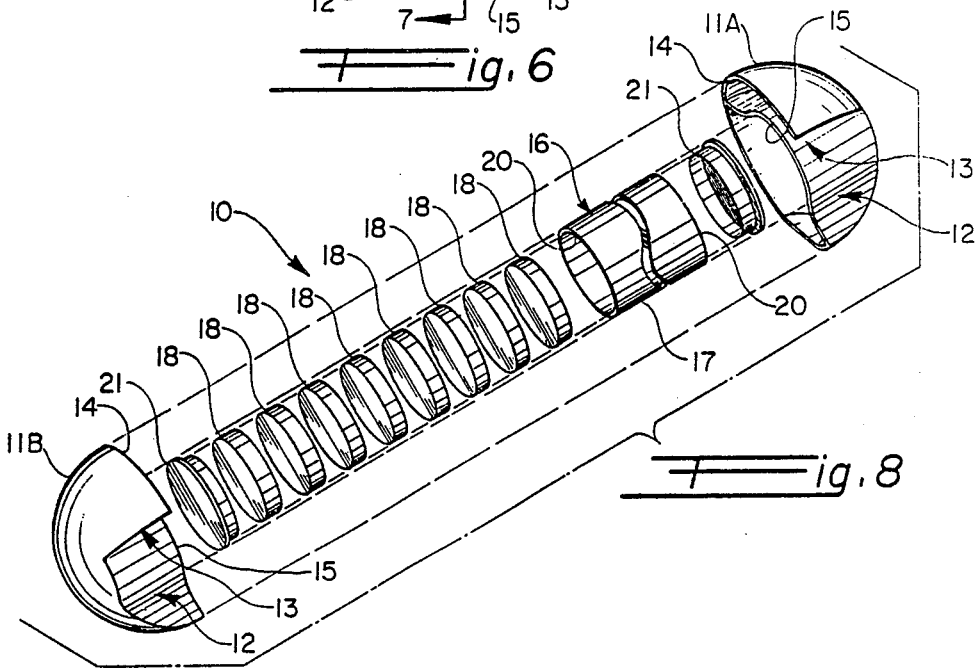
FIG. 8 is an exploded perspective view of the exercise device of FIG. 5.

With reference to FIGS. 2–4, the exercise device 10 includes a substantially-spherical relatively thin-walled housing 11 having a diametral axis designated at A. The housing 11 includes a pair of housing portions 11A and 11B joining at a common midplane B. Each of the housing portions 11A and 11B is preferably substantially hemispherical and identical to one another; moreover, the housing halves 11A and 11B are molded from a suitable plastic material, such as a polycarbonate having relatively high impact strength. However, it will be expressly understood and appreciated by those skilled in the art that the present invention is not so limited.

With this in mind, the housing 11 has a cut-away portion 12 formed therein. The housing further has an opening 13 formed therein substantially tangentially of the housing 11 and communicating with the cut-away portion 12. Through this opening 13, and as shown more clearly in FIG. 3, the hand of the user may be inserted into the housing 11 for use of the exercise device 10.

The housing 11 includes a suitable keying means between the pair of hemispherical portions 11A and 11B, whereby the hemispherical portions are retained together and form the substantially spherical housing 11. Preferably, and as shown more clearly in FIG. 4, this keying means includes an arcuate rib 14 formed on the peripheral edges of each of the housing portions 11A and 11B. These ribs 14 are complementary and are mated when the housing portions 11A and 11B are brought together to form the spherical housing 11. Thereafter, the edges of the housing portions 11A and 11B are glued, ultrasonically welded, or otherwise integrally joined with one another.

Each of the thin-walled housing portions 11A and 11B has a concave inner walled portion 15 forming a circular recess (for purposes hereinafter described).

With further reference to FIGS. 5–8, the weight means comprises a casing 16 disposed within the housing 11 and, preferably, substantially coincident with the diametral axis A of the housing 11 and at right angles to the common midplane B between the housing portions 11A and 11B. The casing 16 has a body portion 17, within which disc-shaped weights 18 and/or "dummy" weights or "fillers" 19 are disposed. Preferably, the casing 16 is substantially cylindrical in shape. However, it is to be understood that any suitable shape of the casing 16 may be employed (and other types of ballast may be employed other than the fillers 19) consonant with the teachings of the present invention. The body portion 17 of the casing 16 further has a pair of opposed ends 20, each of which is preferably open.

A cap 21 is disposed over each open end 20 of the casing 16. The caps 21 aid in retaining the selected weights 18 and/or "fillers" 19 within the casing 16. If desired, the caps 21 may be omitted entirely, with either (or both) opposed end portions 20 being integrally sealed with a respective end wall, or with both ends 20 being left open.

Disposed in the casing 16 is the selected weights 18 and/or "fillers" 19 which are desired to be lifted by the targeted muscle. It is preferred that each weight 18 be shaped substantially coincident with the shape of the interior of the casing 16, and particularly the body portion 17 thereof. If, as in the preferred embodiment, the casing is substantially cylindrical in shape, then each weight 18 and/or "filler" 19, is preferably substantially disc-shaped in appearance and is sized to be received within the body portion 17 of the casing 16. The weights 18 may be fabricated from lead, steel, sand enclosed in plastic, or any other suitable material.

The "dummy" weights or "fillers" 19 may be utilized in place of any one or several of the weights 18. Such "fillers" 19 are preferably fabricated from a foam plastic (or other suitable) material having substantially identical geometric proportions as the weights 18 themselves. By substituting any one or several "fillers" 19 for the "real" weights 18, the weight of the device 10 being lifted by the targeted muscle (the bicep, for example) may vary from substantially zero (wherein all "fillers" 19 and no weights 18 are utilized) to a maximum value (wherein all weights 18 and no "fillers" 19 are utilized).

It is to be understood that any suitable weight or weights may be employed consonant with the teachings of the present invention. In a preferred embodiment, each of the weights 18 weighs 1.25 pounds. If the casing 16 is sized so as to receive eight (8) such 1.25 pound weights 18 therein, then no "fillers" 19 are employed, and basically, a ten (10) pound weight is obtained for the exercise device; and if only four (4) of the weights 18 are employed, then basically, a five (5) pound weight is obtained, in which case four (4) fillers 19 are employed as shown more clearly in FIG. 7. In a preferred embodiment, the complementary hemispherical housing halves 11A and 11B, together, weigh ten ounces (10 oz.) and, if desired, a heavier weight may taken into account in determining the weight of the overall exercise device 10. Moreover, if desired, a heavier weight may be chosen for the housing halves 11A and 11B.

While it is not necessary that such "fillers" 19 be utilized, the use of such "fillers" 19 aids in filling the interior of the casing 16, thereby preventing the weights 18 disposed therein from shifting during the use thereof. If such "fillers" 19 were not provided, then the weights 18 disposed therein may be subject to lateral movements (or "shifting") within the casing 16 during use of the device 10.

As noted herein, each of the hemispherical housing portions 11A and 11B of the relatively thin-walled housing 11 is provided with a concave inner walled portion 15. Each of these concave inner portions 15 receives and supports a respective opposed end 20 of the casing 16 therein, when the hemispherical housing portions 11A and 11B are joined to one another. Preferably, each of the opposed ends 20 is further supported on a respective internal annular shoulder 22 formed in each of the concave inner portions 15.

With reference again to FIG. 3, during use of the exercise device 10 of the present invention to strengthen the user's bicep (for example), the hand of the user is inserted through the opening 13 in the housing 11 and at least partially around the casing 16 radially thereof. In this manner, the user's hand is "cradled" in the hollow spherical housing 11, being at least partially disposed between the casing 16 and the relatively-thin wall of the housing 11. The palm of the user's hand is supported substantially against the convexly-formed inner walled portion 15A, such that the heel of the user's hand is supported substantially on the concave section 15B of the inner walled portion 15.

When utilized in this fashion, the user's hand at all times remains in a comfortable, natural "at rest" position. In such a manner, a forceful grip by the user is not required throughout the full range of motion of the exercise device 10, such that the necessity for employing the user's muscles which adjoin the bicep (the conjunctive muscles) is substantially reduced. As a result, the device 10 substantially reduces the tendency to detract from the development of the user's targeted muscle (in this case, for example, the bicep).

Figure 9:
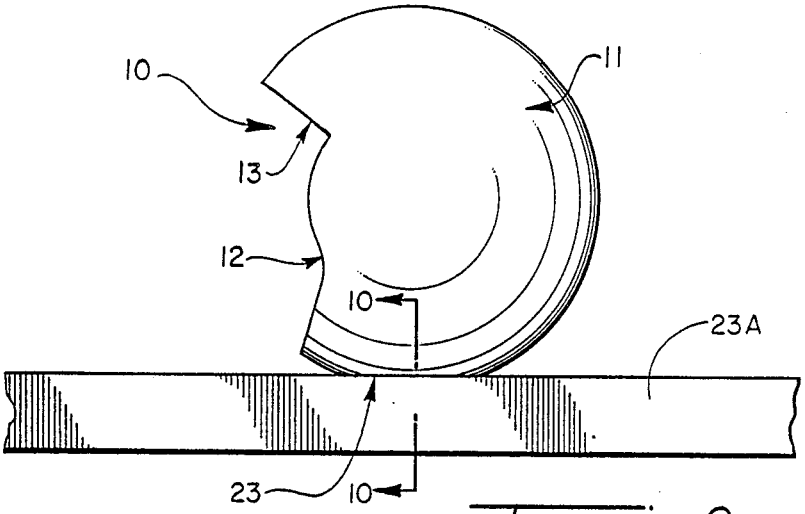
FIG. 9 shows the positioning of the exercise device of the present invention upon a table (or other surface) so that the exercise device will not roll off the table.
Figure 10:
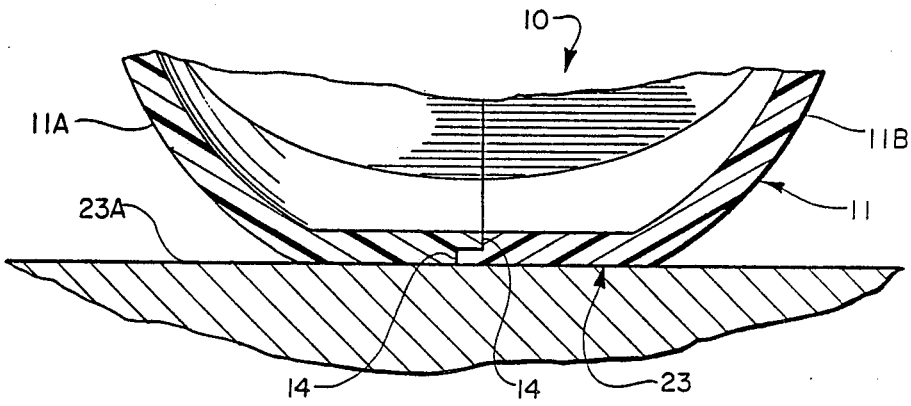
FIG. 10 is a section view thereof, taken along lines 10—10 of FIG. 9, and drawn to an enlarged scale.

With reference to FIGS. 9 and 10, the outer surface of the housing 11 may, if desired, be truncated to form a flat surface 23 thereon. Provision of this flat surface 23 aids in preventing the device from rolling when the exercise device 10 is placed on a substantially flat surface, such as a table 23A as illustrated in FIGS. 9 and 10.

Figure 11:
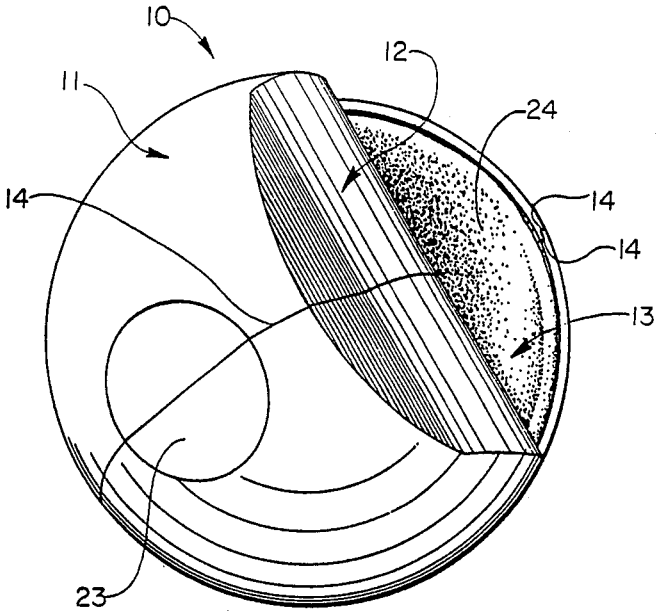
FIG. 11 is another perspective view of the exercise device of the present invention, showing the padding disposed within the housing for providing a cushion for the hand of the user during use of the device.
Figure 12:
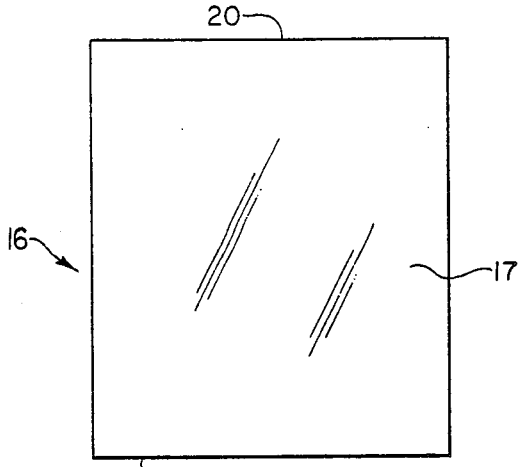
FIGS. 12–20 are sequence views, illustrating the method for forming and assembling a preferred embodiment of the exercise device of the present invention.
Figure 14:
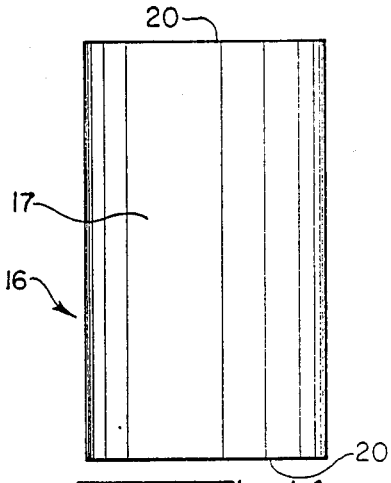
Figure 13:
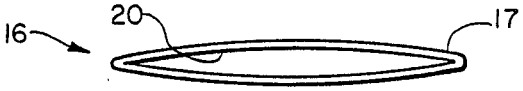
Figure 15:
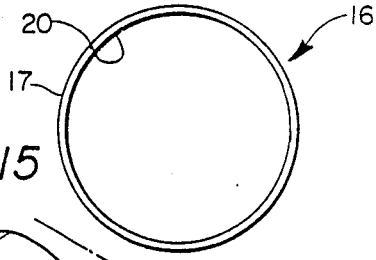

With reference to FIG. 11, in a preferred embodiment of the exercise device 10, a padding 24 (or other suitable means) may be disposed within the housing 11 and between the casing 16 and the housing 11. In this manner, a cushion is provided for the hand of the user which is disposed in the exercise device 10 during use thereof. Additional padding may be disposed within the housing 11, opposite to the padding 24, if desired.

With reference to FIGS. 12–20, there is illustrated the sequence of steps comprising the preferred method for assembling and forming the exercise device 10 of the present invention. Preferably, each of the hemispherical housing portions 11A and 11B is molded from a relatively high-impact strength polycarbonate or other plastic or suitable material; and, as previously described, the hemispherical housing portions 11A and 11B are formed as mirror images of each other. If desired, the casing 16 may be molded as a sleeve or tubing or else extruded; but in the preferred embodiment, the body portion 17 of the casing 16 comprises a flexible plastic sleeve which is folded flat for shipment (as shown more clearly in FIGS. 12 and 13) and then is unfolded (as shows more clearly in FIGS. 14 and 15) into a substantially cylindrical shape for use in the fabrication and assembly of the overall exercise device 10. The cylindrical body portion 17 is sold under the trademark "JETRAN" by SLM Manufacturing Corp. (of Somerset, N.J.). Caps 21 are formed for each respective open end of the cylindrical body portion 17.

Figure 16:
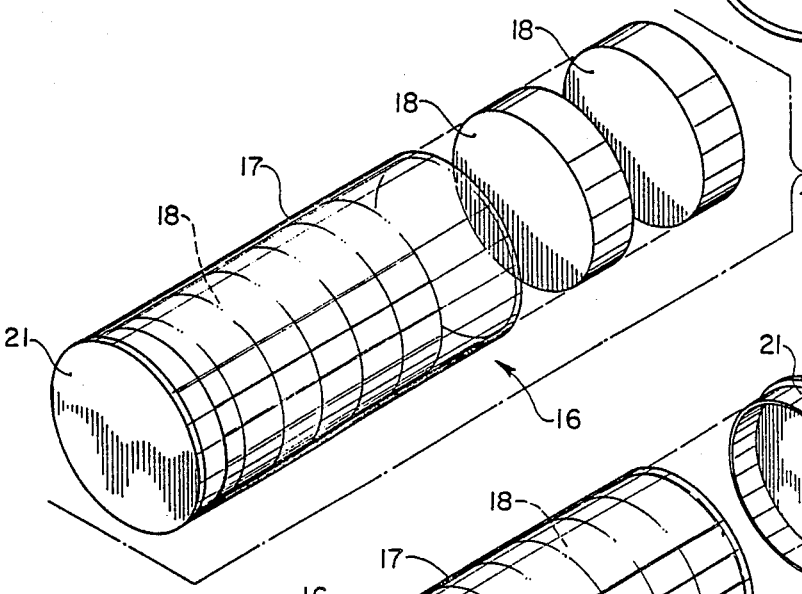
Figure 17:
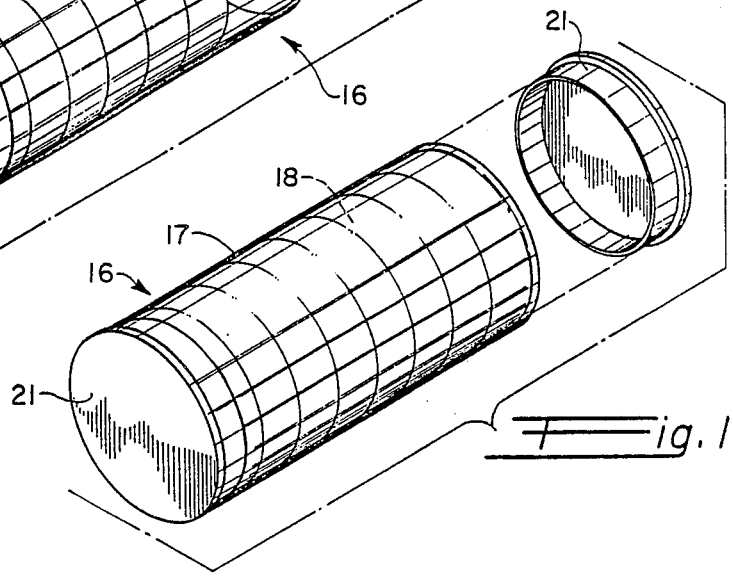

Referring to FIGS. 16 and 17, the cylindrical body portion 17 of the casing 16 has a cap 21 disposed on one of the open opposed ends 20 thereof. The desired weights 18 and/or "fillers" 19 are then received within the cylindrical body 17. The other cap 21 is then disposed on the other of the open opposed end portions 20 of the cylindrical body 17, whereby the weights 18 and/or "fillers" 19 are retained in the cylinder. If desired, these caps 21 may be either removably disposed over each respective end portion 20, whereby the weights 18 and/or "fillers" 19 are removably retained therein, or the caps 21 may be disposed over each respective end portion 20 and integrally secured in place therein, so that the weights 18 and/or "fillers" 19 are permanently retained therein. It is to be noted that the caps 21 may be disposed over each of the end portions 20 in the order described above or a cap 21 may be placed over each respective end portion 20 after the desired weight 18 and/or "fillers" 19 have been disposed in the cylinder 17.

Figure 18:
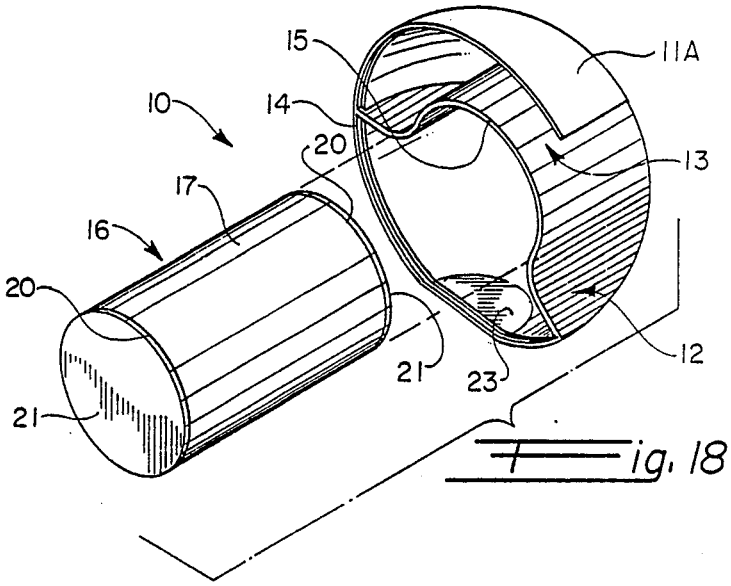
Figure 19:
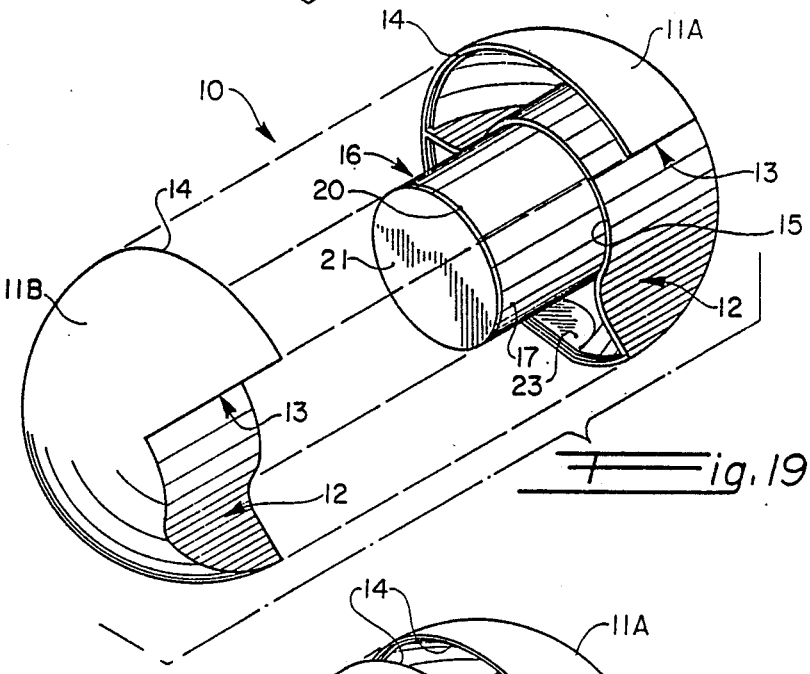
Figure 20:
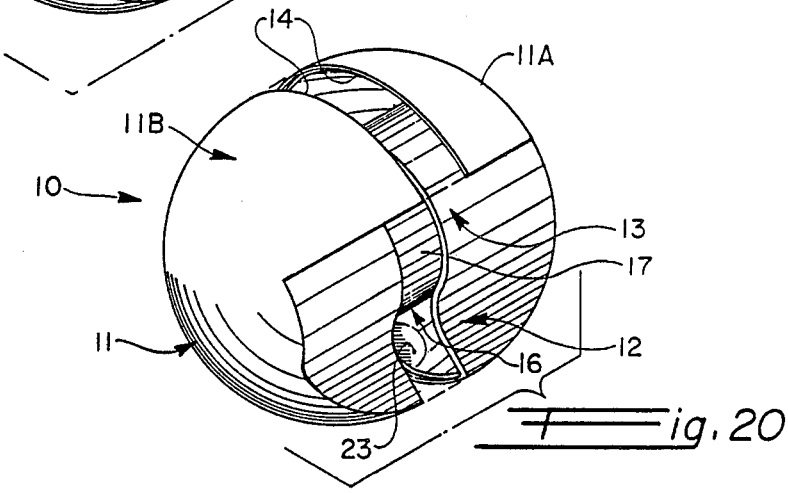

Referring to FIGS. 18–20, the assembled cylindrical casing with the weights 18 and/or fillers 19 therein then has one of the opposed ends 20 inserted into a respective concave inner portion 15 of one of the hemispherical housing portions 11A as shown more clearly in FIG. 18. There, the opposed end 20 is received on and abuts the internal annular shoulder 22, wherein the opposed end 20 of the cylindrical casing 16 is supported. Then the other of the opposed ends 20 is inserted into the other respective concave inner portion 15 of the other hemispherical housing portion 11B (as shown more clearly in FIGS. 19 and 20). There, the other opposed end 20 is received on and abuts the internal annular shoulder 22 therein, wherein the other opposed end 20 of the cylindrical casing 20 is supported.

The respective hemispherical housing portions 11A and 11B are then aligned with one another and brought together, as shown in FIG. 20, such that the arcuate ribbed edges 14 of the hemispherical housing portions 11A and 11B contact one another. The housing portions 11A and 11B are integrally joined together by a suitable adhesive, sonic or ultrasonic welding, or other suitable means. In this manner, a substantially spherical housing 11 having a single diametral axis and a single cut-away portion 12 is formed. The housing 11 further has a single opening 13 formed therein, substantially tangentially of the housing 11 and in communication with the cut-away portion 12 thereof for the hand of the user to be inserted during use, as herein described. If desired, the housing 11 could have a built-in cylindrical casing formed therein to receive the weights 18, etc., in which case a separate cylinder 17 would not be necessary.

Figure 21:
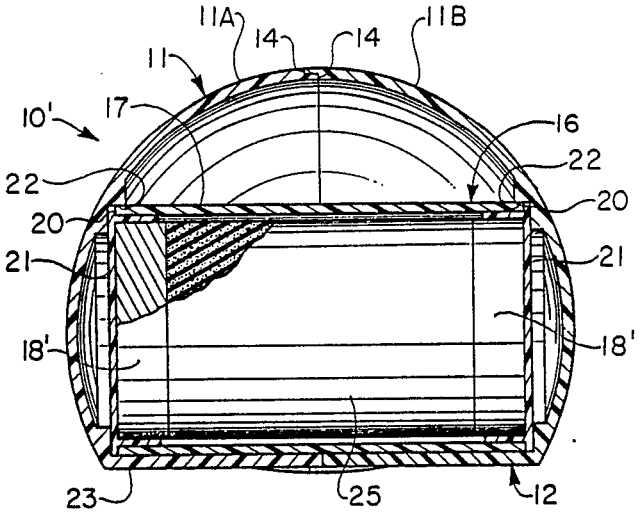
FIG. 21 is a longitudinal section of a second embodiment of the present invention, corresponding substantially to that of FIG. 5, but showing a pair of circular discs separated by a dowel rod to form the cylindrical weight means within the housing.
Figure 22:
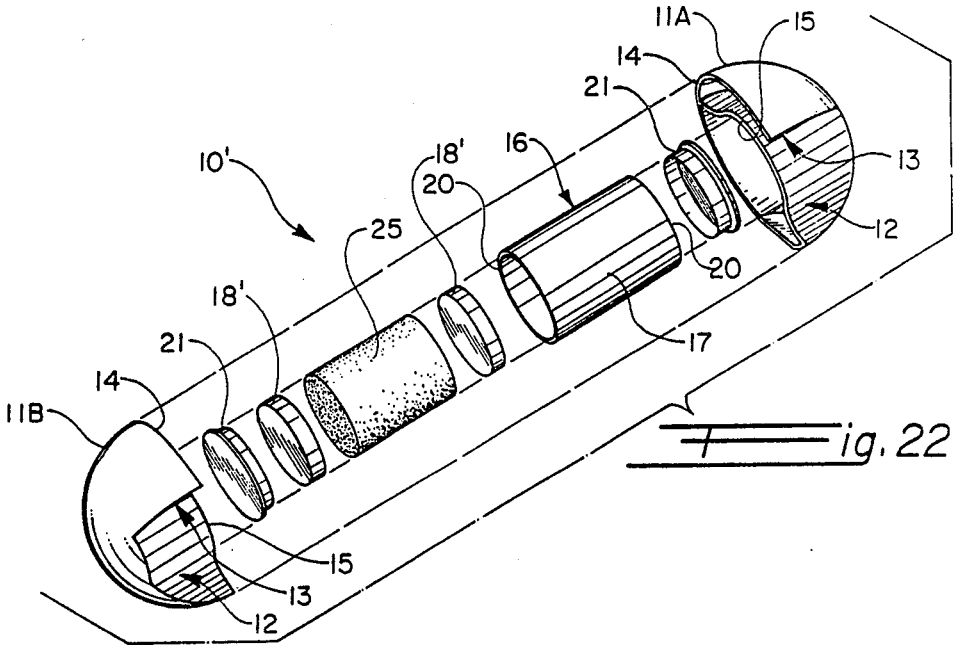
FIG. 22 is an exploded perspective view thereof.

With reference to FIGS. 21 and 22, constituting a first alternate embodiment 10' of the present invention, a pair of disc-shaped weights 18' are separated by a cylindrical "dummy" block or dowel rod 25. The outer diameter ("O.D.") of the weights 18' and the dowel rod 25 remain substantially constant; however, the thickness of the disc-shaped weights 18' (and the length of the cylindrical dowel rod 25) may be changed to provide a heavier (or lighter) weight for the exercise device 10'. This accommodates a range of exercise devices of different weights, thus facilitating an entire product line using the same housing members 11A and 11B. Like the other embodiments of the present invention, this achieves market expansion and penetration consonant with manufacturing standardization.

Figure 23:
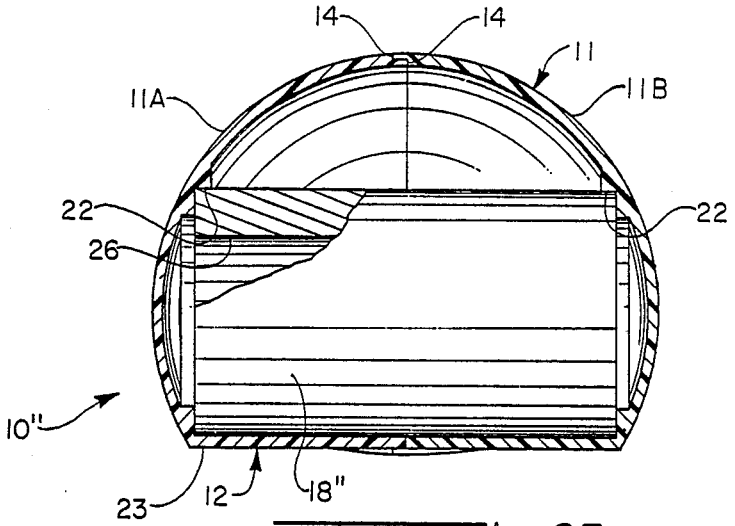
FIG. 23 is a longitudinal section of a third embodiment of the present invention, corresponding substantially to that of FIG. 5, but showing a weighted sleeve to form the cylindrical weight means within the housing.
Figure 24:
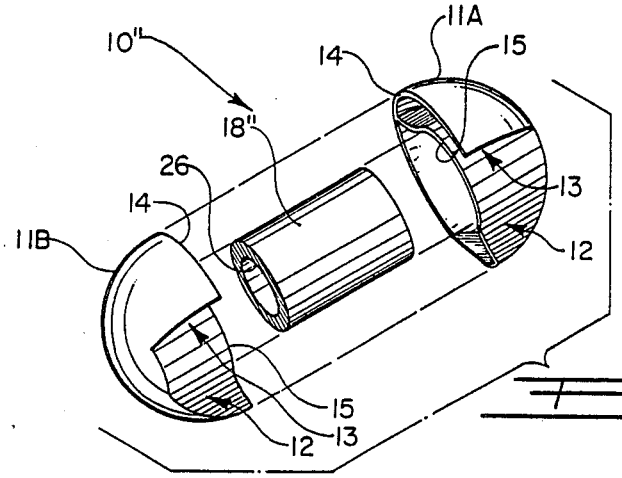
FIG. 24 is an exploded perspective view thereof.

With reference to FIGS. 23 and 24, constituting a second alternate embodiment 10'' of the present invention, a weight 18'' comprising a single cylindrical sleeve is disposed between the respective housing portions 11A and 11B. The cylindrical weight 18'' has a central bore 26 formed therein. Thus, the cylindrical weight 18'' has a substantially constant length; but the bore 26 may have a variable diameter, thereby changing the effective weight thereof for accommodating a desirable product line of exercise devices 10''.

Figure 25:
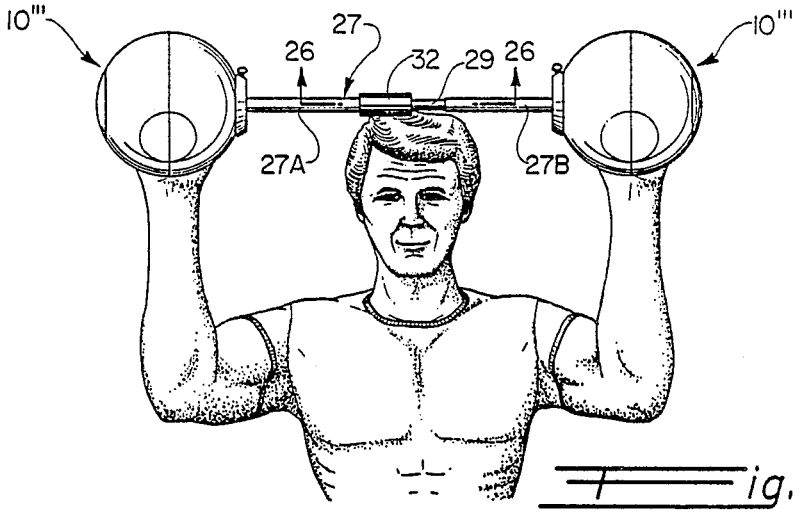
FIG. 25 illustrates how two of the exercise devices of the present invention may be used in combination with a telescoping bar therebetween to form an improved exercise device, the use of which is somewhat similar to that of a conventional barbell.
Figure 26:
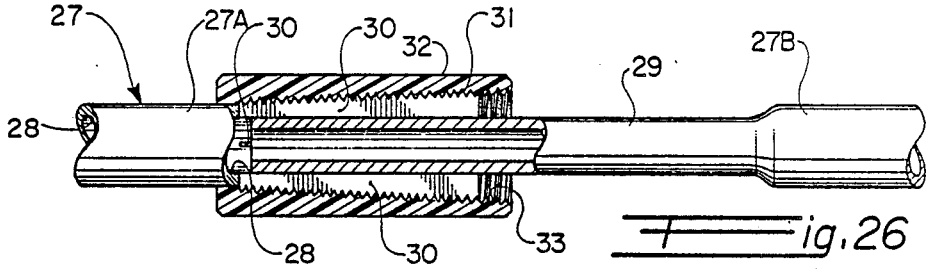
FIG. 26 is a section view (with parts thereof in elevation) taken along the lines 26—26 of FIG. 25, drawn to an enlarged scale, and showing the telescoping members of the bar.
Figure 27:
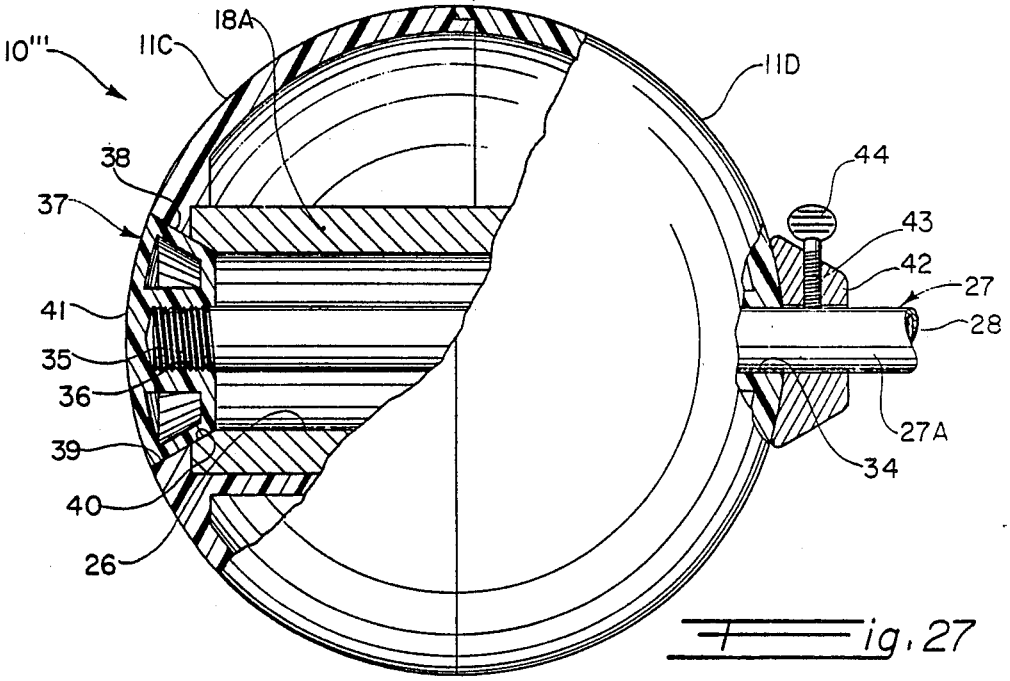
FIG. 27 is a further section view, taken along the lines 27—27 of FIG. 25, drawn to an enlarged scale, and showing the coupling of one of the exercise devices of the present invention to the telescoping bar.

With reference to FIGS. 25–27, a pair of exercise devices of the present invention may be suitably coupled together to form a barbell type of device.

More specifically, an exercise device 10''' is carried on the respective ends of a bar 27. The bar 27 includes telescoping bar members 27A and 27B. Bar member 27A is preferably tubular and has an axial bore 28 to receive a reduced-diameter portion 29 of bar member 27B, as shown more clearly in FIG. 26. Bar member 27A has four circumferentially-spaced slots 30 formed therein, and the outer diameter of bar member 27A is provided with external threads 31 radially of the slots 30. The reduced-diameter portion 29 of bar member 27B is slidably received in the axial bore formed in the tubular bar member 27A to the desired depth to adjust the length of the bar 27 to suit the convenience of the individual user. A clamping collar 32 is slidably carried by the bar member 27A and has an internal taper which is complementary to the external taper on the bar member 27A. The clamping collar 32 has internal threads 33 which engage the external threads 31 on the bar member 27A and exert a radially inwardly-directed pressure on the respective portions of bar member 27A intermediately of the circumferentially-spaced slots 30 formed thereon, thereby securely clamping the bar member 27A to the reduced-diameter portion 29 of the bar member 27B, and thereby retaining the bar 27 in its desired adjusted length. However, it will be appreciated by those skilled in the art that other means for adjusting the length of the bar 27 may be employed consonant with the teachings of the present invention.

With further reference to FIG. 27, the exercise device 10''' includes housing halves 11C and 11D integrally joined together at their peripheral ribbed edges 14, respectively, and exercise device 10''' carries a sleeve weight 18A having a bore 26. Housing half 11D has an opening 34 to receive the bar member 27A, which is telescopically received concentrically within the sleeve weight 18A. The end of bar member 27A is threaded, as at 35, to cooperate with the internally-threaded boss 36 of a clamping disc 37. Clamping disc 37 has a conical or tapered side surface 38 which wedges within a complementary internally-tapered or conical opening 39 formed in housing half 11C. The tapered surface 38 of clamping disc 37 also wedges against an annular chamfered surface 40 formed on the sleeve weight 18A, thereby securely retaining the weight 18A within the housing halves 11C and 11D. The outer surface 41 of clamping disc 37 is formed as a portion of a sphere (as shown more clearly in FIG. 27) so that in the overall assembly, the outer surface 41 of clamping disc 37 forms a smooth continuation of the spherical contours of the exercise device 10''' and, more particularly, its housing half 11C. The bar member 27A also carries a slidable locking collar 42 provided with a set screw 43 having a thumb-actuated portion 44, thereby retaining the exercise device 10''' on the bar member 27A. Bar member 27B has a similar connection with exercise device 10'''. With this arrangement, the exercise devices may be quickly and conveniently removed from the bar 27 and replaced with exercise devices having different weights, as desired, so that the full range of the dual exercise devices is facilitated.

With reference to FIGS. 28–35, the wide-ranging utility and application of the present to the accelerated development of various targeted muscles of the user, besides the bicep illustrated in FIG. 1, will be more readily appreciated. In FIGS. 28–35, the full lines illustrate the natural "at rest" positions, while the broken lines illustrate the stressed positions during use of the exercise device of the present invention. Moreover, it will be appreciated by those skilled in the art that the respective representations of FIGS. 28–35 are illustrative of the present invention and not limiting thereof.

Figure 28:
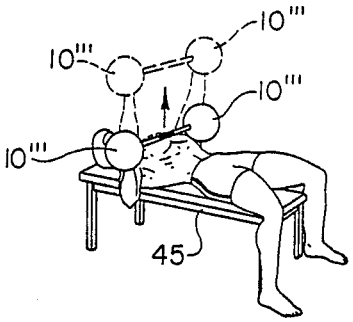
FIGS. 28–35 schematically illustrate various examples for use of the exercise devices of the present invention for the development and improvement of respective targeted muscles.
Figure 29:
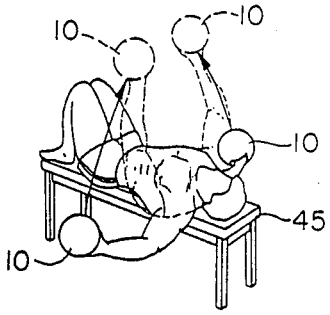
Figure 30:
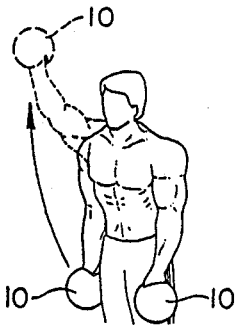
Figure 31:
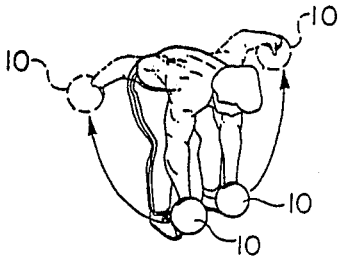
Figure 32:
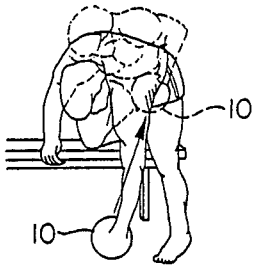
Figure 33:
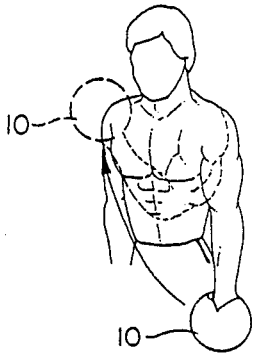
Figure 34:
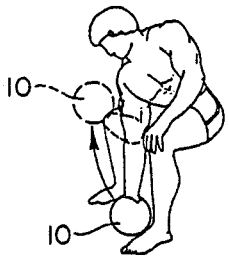
Figure 35:
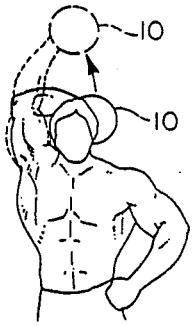

With this in mind, FIGS. 28 and 29 illustrate the use of the exercise devices of the present invention for primarily developing and strengthening the chest muscles, as the user lies on a bench 45. FIGS. 30 and 31 illustrate the use of the exercise devices for primarily strengthening the shoulder muscles; FIG. 32 for the back muscles; and FIGS. 33–35 are for the arm muscles. FIG. 30 is a front deltoid raise. FIG. 31 is a bent-over lateral raise;

FIG. 32 is a one-arm latissimus row; FIG. 33 is an alternate bicep curl; FIG. 34 is a bicep concentration curl; and FIG. 35 is a tricep extension.

In each case, the user's specific targeted muscle is being developed and strengthened. Since it is not required to exert a firm grip or grasp on the improved exercise devices of the present invention, the use of the adjoining or conjunctive muscles is at least substantially reduced, if not eliminated altogether. Thus, a smaller overall weight may be employed in the exercise devices, yet the beneficial effect will be substantially magnified; and, in a preferred embodiment, the improved exercise devices of the present invention have a beneficial effect which is substantially equal to a conventional weight of approximately 3.5 times the weight of the exercise device of the present invention. Viewed in another aspect, it will be appreciated that with the same exercise time period, the beneficial effect of the exercise devices of the present invention will be substantially enhanced over the use of the conventional devices of the prior art; or, conversely, a substantially reduced exercise time period may be employed to achieve approximately the same beneficial effect normally obtained by using a conventional device over a substantially larger exercise time period.

Moreover, with the same basic design, it is possible to manufacture and market a wide range of exercise devices of various respective weights. Thus, an entire product line has been facilitated for rapid development and market expansion and penetration, yet consonant with manufacturing standardization and relatively low-cost volume production methods.

Obviously, many modifications may be made without departing from the basic spirit of the above invention. For example, the cylindrical casing 16 may be dispensed with (if desired) and complementary cylindrical casings could be integrally molded within the hemispherical housing portions 11A and 11B, such that the desired weights 18 (and/or fillers 19) may be received directly therein. Additionally, the housings for the exercise devices of the present invention may be made of a relatively soft or pliable material, thereby customizing the exercise devices for use by children or handicapped persons going through physical therapy. Indeed, it is even feasible, consonant with the teachings of the present invention, to integrally cast or otherwise suitably form the exercise devices of a substantially solid material (with or without an internal ballast) yet having the same tangential opening and convexo-concave inner wall or surface to accommodate the user's hand without requiring the user to exercise a forceful grip.

Referring to FIGS. 36–40, an alternate embodiment of the exercise devices of the present invention is illustrated. This embodiment has improved strength and flexibility, incorporates all of the desirable features of the previous embodiment, and yet facilitates standardized manufacture of the devices with relatively large variations in weight being readily accommodated. In this alternate embodiment, the peripheral edges of the housing portions have a solid tongue-and-groove mating relationship with one another, and the respective housing portions are secured to respective opposite ends of the weight means.

Like the previous embodiments of the exercise devices described above, the exercise device 100 includes a housing 101 having a weight means disposed therein. Preferably, the wall thickness of this housing 101 is larger than the thickness of the housing wall of the previous embodiments.

As was described for the previous embodiments, a tangential opening 102 is formed in the housing 101. This opening 102 is bounded by an outer wall 103 and by an inner wall 104. Inner wall 104 has a convex portion 105, and outer wall 103 has a concave portion 106. The hand of the user may be inserted through the tangential opening such that the user's hand is disposed between the inner and outer walls 103 and 104, respectively.

As previously described, the palm of the user's hand is disposed adjacent to the convex portion 105 of the inner wall 104, and the heel of the user's hand is disposed adjacent to the concave portion 106 of the outer wall 103. Thus, a forceful grip is not required by the user during use of the exercise device 100, thereby substantially reducing the necessity for employing the user's conjunctive adjoining muscles, which would (otherwise) have a tendency to detract from the development of the user's targeted muscle.

The opposite ends of the weight means 107 are removably secured to respective diametrically-opposed portions or shells 101A and 101B of the housing 101, and the peripheral annular edges of the respective housing portions 101A and 101B are held together in a solid mating relationship.

Figure 36:
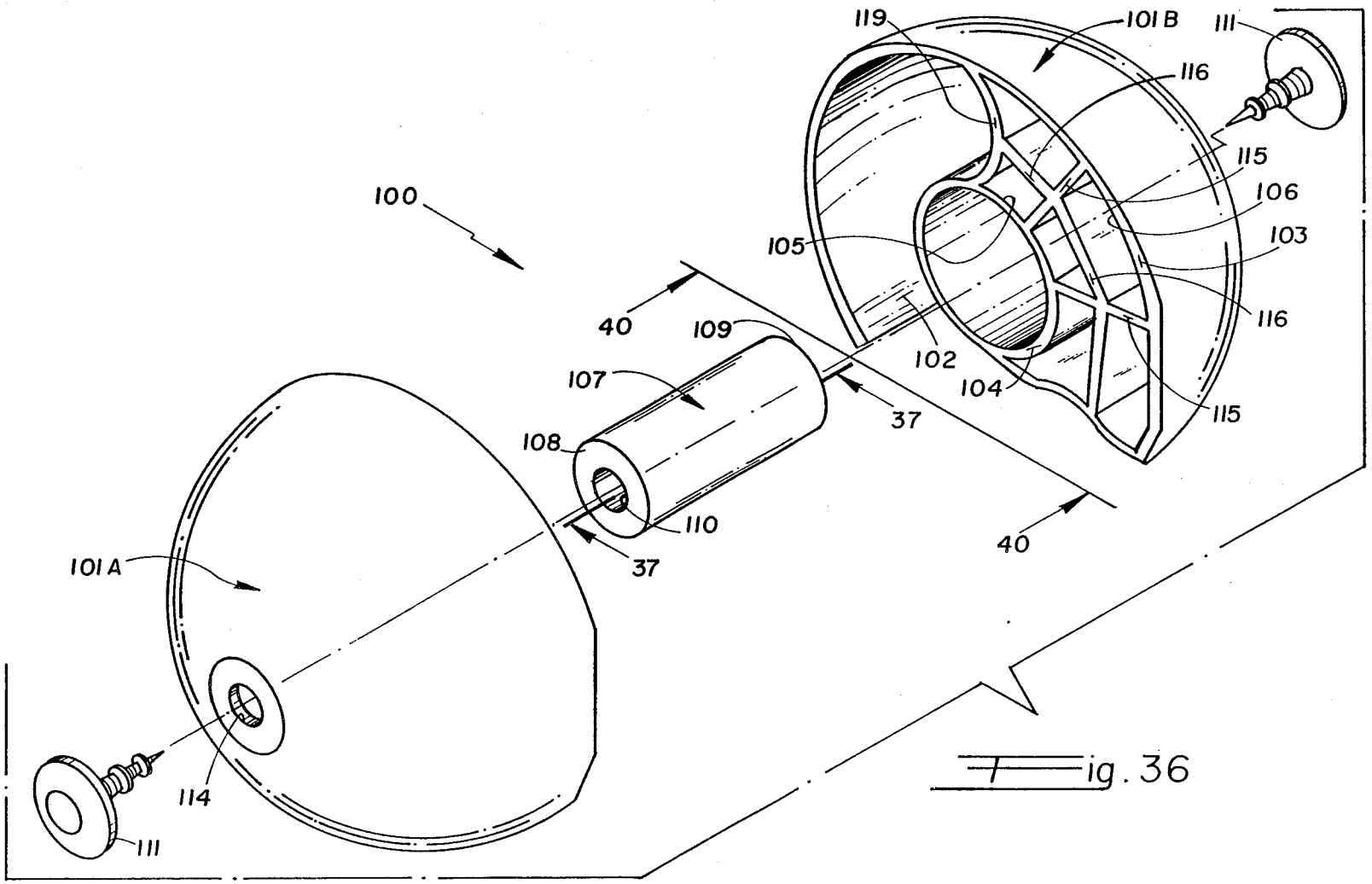
FIG. 36 is an exploded perspective view of a fourth embodiment of the present invention, wherein the ends of the weight are removably secured to the housing portions by cap screws, respectively, and wherein the outer diameter of the weight may be changed to vary the weight of the exercise device.
Figure 37:
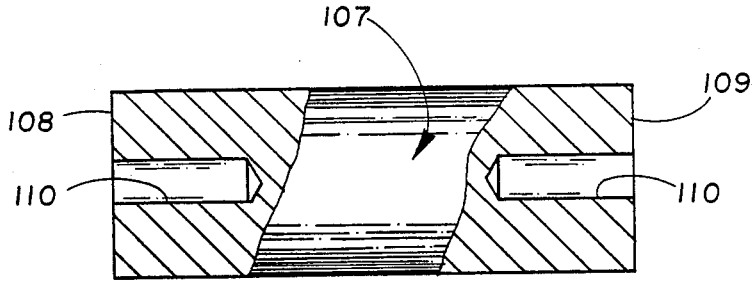
FIG. 37 is a longitudinal cross-section of the weight means, taken along line 37—37 of FIG. 36 and drawn to an enlarged scale.

Referring to FIGS. 36 and 37, preferably the weight means 107 comprises a single solid weight having a pair of opposite ends 108 and 109. It is contemplated herein that this weight 107 (like the cylinder 16 of, for example, FIG. 8) will be substantially cylindrical in cross-section. However, other configurations of the weight means 107 are equally applicable consonant with the teachings of the present invention. Preferably, each of the opposite ends 108 and 109 of the weight 107 has a blind axial bore 110 formed therein. These opposite ends 108 and 109 are secured to the respective diametrically-opposed portions 101A and 101B of the housing 101 by a suitable fastening means.

The annular peripheral edges of the two molded hemispherical housing shells 101A and 101B join together along a common longitudinal midplane constituting the parting line of the housing 101, and the weight 107 is secured between the housing shells 101A and 101B transversely of the common longitudinal midplane therebetween.

The provision of the single weight 107 (secured directly to the housing portions 101A and 101B) eliminates potential slippage and shifting of the weight in the housing 101. Thus, the exercise device 100 has increased stability during the use thereof.

Having a single weight also standardizes the manufacture of the exercise devices. The effective quantity of the weight 107 may be varied by varying the outer diameter ("O.D.") thereof. In the previous embodiments (described above) the outer diameter of the weight means remains constant, with the effective quantity (or weight) of the weight means being varied by varying the inner diameter thereof. Altering of the inner diameter, or requiring the use of many more weights, is more expensive. In this respect, the use of the single solid weight 107 avoids manufacturing problems, provides standardization, and facilitates an improved product having greater reliability.

Figure 38:
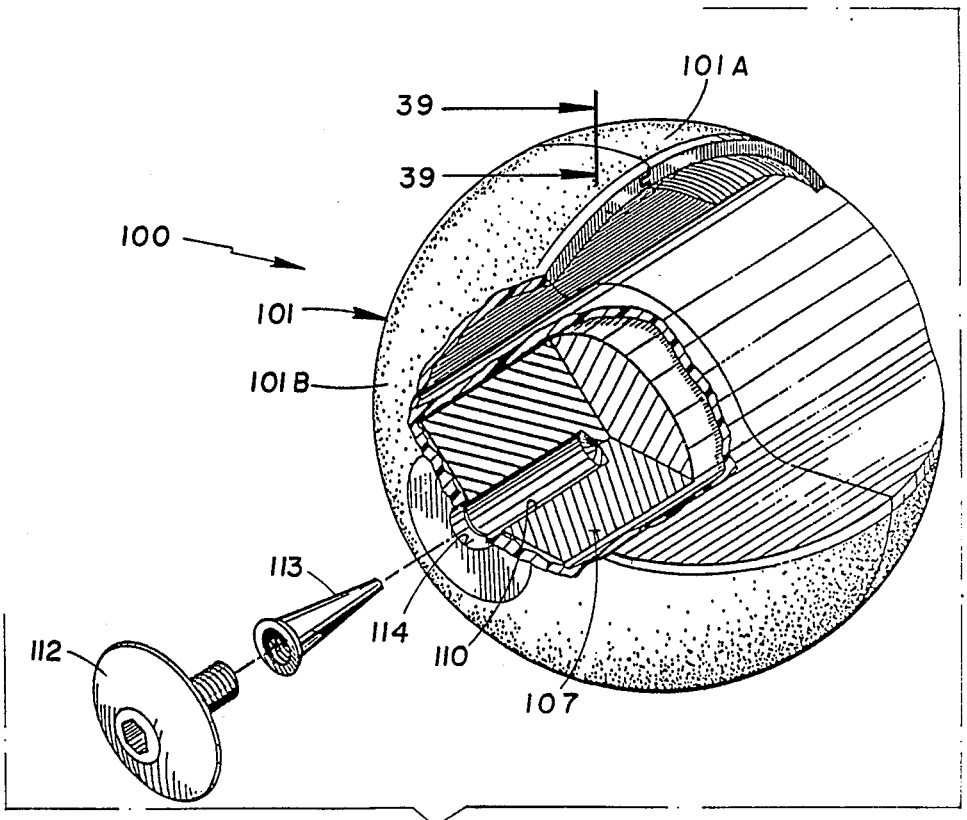
FIG. 38 is a perspective view of the embodiment of FIG. 36 in its assembled relationship, but with certain parts thereof broken away and sectioned, and further showing an alternate fastening means.

The means for securing each of the opposite ends 108 and 109 of the weight 107 to the respective diametrically-opposed portions 101A and 101B of the housing 101 includes a pair of cap screws 111 (or other suitable fastening means). Each of the cap screws 111 is directly inserted and received in a respective bore 110 in the weight 107. These cap screws 111 may be self tapping (as shown in FIG. 36); however, if desired, a screw 112 may cooperate with an expandable anchor 113 which is inserted into the bore 110, as shown in FIG. 38. The anchor 113 expands as the screw 112 is received in the bore 110 in the weight 107. The screws (111 or 112) pass through apertures 114 in the housing portion 101A and 101B, respectively.

In this manner, the housing portions 101A and 101B of the housing 101 are removably secured to the opposite ends 108 and 109, respectively, of the weight 107, such that the housing portions 101A and 101B are removably secured to each other.

Figure 40:
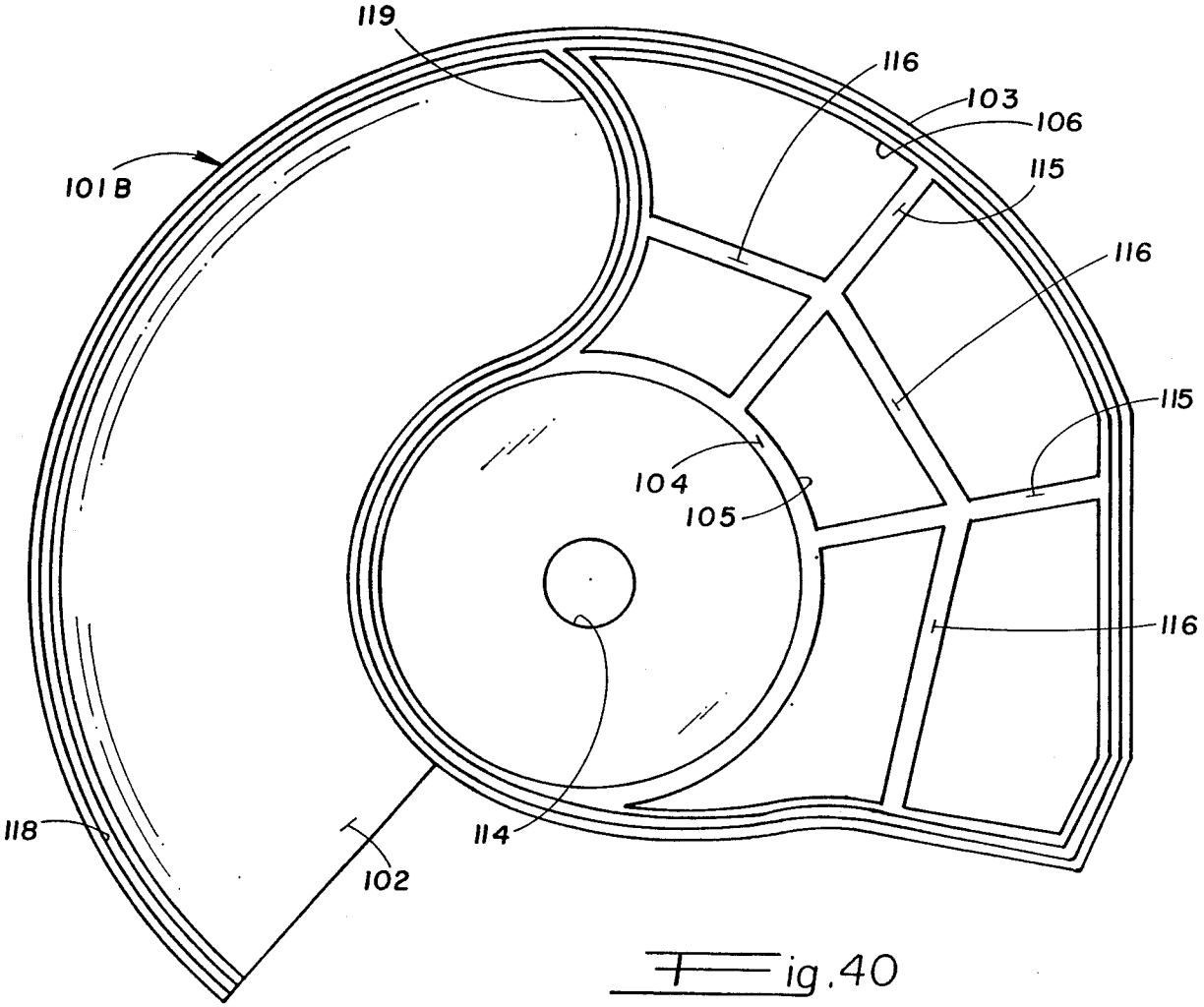
FIG. 40 is a first elevational view of one of the housing portions or shells, as viewed from the lines 40—40 of FIG. 36 and drawn to an enlarged scale.

Each housing portion 101A and 101B has a plurality of radially-extending respective strengthening ribs (or struts) 115 formed thereon, as shown more clearly in FIG. 40. These struts 115 extend between the inner (convex) wall 104 and the outer (concave) wall 103 of each housing half 101A and 101B. Additionally, cross ribs 116 join the struts 115 (being integrally molded therewith) to provide additional radial and circumferential strength to the housing portions 101A and 101B. These struts 115 and cross ribs 116 are desirable where a particularly heavy weight (i.e. forty pounds or heavier) is disposed in the exercise device 100 (but may not be necessary where lighter weights are employed).

Figure 39:
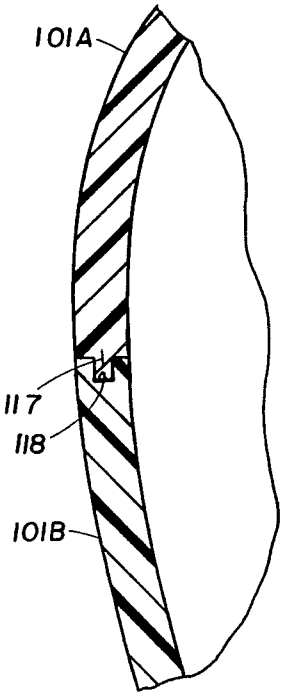
FIG. 39 is a partial cross-sectional view thereof, taken along the lines 40—40 of FIG. 38 and drawn to an enlarged scale, and showing the tongue-and-groove mating relationship of the two hemispherical housing portions or shells along their respective annular peripheries.

Referring to FIG. 39, in addition to FIG. 36, the housing portions 101A and 101B are keyed together by a tongue-and groove arrangement, which permits the peripheral edges of the housing portions 101A and 101B to mate solidly with one another. In this arrangement, the annular peripheral edge of one of the housing portions 101A (or 101B) has an annular tongue 117 formed thereon; and the annular peripheral edge of the other of the housing portions 101B (or 101A) has a complementary annular groove 118 formed therein and sized so as to receive the tongue 117 therein in a mating relationship. This tongue-and-groove arrangement provides greater security against slippage or relative movement of the housing portions 101A and 101B relative to one another, especially when the exercise device 100 is under greater stress due to the use of heavier weights.

An internal wall 119 (see FIG. 36) limits the insertion of the user's hand in the exercise device 100 (similar to the internal wall shown in FIG. 3 of the previous embodiments). This internal wall 119 projects radially and joins the inner wall 104 to the outer wall 103.

Having thus described the invention, it will accordingly be appreciated by those skilled in the art that within the scope of the appended claims, the invention may be practiced other than has been specifically described therein.

What is claimed is:

1. An exercise device comprising a housing including a pair of complementary diametrically-opposed housing portions, the housing having a weight means disposed therein and further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that the palm of the user's hand rests substantially on the convex portion of the inner wall, and such that the back of the user's hand rests substantially on the concave portion of the outer wall, whereby a forceful grip is not required by the user, and whereby the necessity for employing the user's conjunctive adjoining muscles is substantially reduced, thereby substantially reducing the tendency to detract from the development of the user's targeted muscle, and the weight means having a pair of opposite ends, each of which is secured to a respective housing portion.

2. The exercise device of claim 1, wherein the housing portions having respective peripheral edges along which the housing portions mate, and means for securing each of the opposite ends of the weight means to a respective diametrically opposed portion of the housing, such that the peripheral edges of the housing portions mate with one another, thereby forming an integral housing.

3. The exercise device of claim 2, wherein the peripheral edge of one of the housing portions has a tongue formed thereon, and wherein the peripheral edge of the other of the housing portions has a groove formed therein to receive the tongue in a mating relationship.

4. The exercise device of claim 2, wherein the means for securing each of the opposite ends of the weight means to a respective diametrically opposed portion of the housing includes a pair of cap screws, each cap screw being removably disposed through a respective housing portion and being received in a respective opposite end of the weight means, thereby removably securing the housing portions to the respective opposite ends of the weight.

5. The exercise device of claim 4, wherein each of the opposite ends of the weight means has a blind axial bore formed therein for receiving one of the respective cap screws therein.

6. The device of claim 5, wherein the cap screws are self tapping for being threaded directly into one of the respective blind axial bores.

7. The exercise device of claim 5, wherein each cap screw is received within a respective expandable anchor disposed in the respective bore.

8. The exercise device of claim 4, wherein each of the respective housing portions has an aperture formed therein, through which a respective cap screw is disposed when securing each of the opposite ends of the weight means to a respective diametrically opposed portion of the housing.

9. The exercise device of claim 1, wherein each housing portion includes a plurality of strengthening struts formed therein between the inner and outer walls thereof.

10. An exercise device comprising a housing having a weight means disposed therein, the housing further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that the palm of the user's hand rests substantially on the convex portion of the inner wall, and such that the back of the user's hand rests substantially on the concave portion of the outer wall, whereby a forceful grip is not required by the user, and whereby the necessity for employing the user's conjunctive adjoining muscles is substantially reduced, thereby substantially reducing the tendency to detract from the development of the user's targeted muscle, the housing portion including a pair of complementary semi-spherical housing portions having respective annular peripheral edges along which the housing portions mate, the peripheral edge of one of the housing portions having a tongue formed thereon, and the peripheral edge of the other of the housing portions having a groove formed therein to receive the tongue in a mating relationship, such that the peripheral edges of the housing portions mate with one another, the weight means having a pair of opposite ends, each of the opposite ends having a blind axial bore formed therein, and a pair of cap screws, each cap screw being removably disposed through a respective housing portion and received in one of the respective blind axial bores formed in the opposite ends of the weight means, thereby removably securing the housing portions to the respective opposite ends of the weight means.

11. In an exercise device, the combination of a housing including complementary housing halves, each of which is relatively thin-walled, the housing halves having respective peripheral edges mated together along a common midplane between the housing halves, a weight means disposed within the housing, the weight means having a pair of opposite ends, means for securing each of the housing halves to a respective opposite end of the weight means, such that the housing halves are secured to one another with their respective peripheral edges mated together along the common midplane, the housing having an opening formed therein substantially tangentially of the housing, whereby the hand of the user may be inserted through the opening in the housing and at least partially around the weight means radially thereof, the user's hand being disposed at least partially between the weight means and the wall of the housing, such that a forceful grip is not required by the user, and such that the necessity for employing the user's conjunctive adjoining muscles is substantially reduced, thereby substantially reducing the tendency to detract from the development of the user's targeted muscle.

12. In an exercise device including a housing having a weight means disposed therein, the housing further having an opening formed therein substantially tangentially of the housing, the opening being bounded by an outer wall and an inner wall, whereby the hand of the user may be inserted through the opening in the housing, such that the user's hand is disposed between the inner and outer walls, such that the palm of the user's hand rests substantially on the inner wall, whereby a forceful grip is not required by the user, and whereby the necessity for employing the user's conjunctive adjoining muscles is substantially reduced, thereby substantially reducing the tendency to detract from the development of the user's targeted muscle, the improvement wherein the weight means has a pair of opposite ends, each of which is secured to the housing.

13. An exercise device, comprising a substantially spherical housing having an opening through which the user's hand may be inserted, the housing having a pair of complementary hemispherical shells joining together along their respective circumferential edges about a common midplane, a weight disposed between the complementary hemispherical shells and disposed substantially transversely of the common midplane between the shells, the weight having a pair of end portions, respectively, and means for securing each shell to a respective end portion of the weight.

14. The exercise device of claim 13, wherein the weight is substantially cylindrical and has an outer diameter, and wherein the outer diameter of the weight may be varied to vary the effective weight of the exercise device.

15. The exercise device of claim 13, wherein each shell includes a relatively-thin outer wall having a concave inner surface, each shell further including an inner wall having a convex outer surface, such that the opening for the user's hand is disposed between the inner and outer walls, the opening being substantially tangentially of the housing, wherein a forceful grip is not required by the user, and whereby the necessity for employing the user's conjunctive adjoining muscles is substantially reduced, thereby substantially reducing the tendency to detract from the development of the user's targeted muscles.

16. The exercise device of claim 15, further including radially-projecting struts between the respective inner and outer walls.

17. The exercise device of claim 16, further including cross ribs integrally joining the radially-projecting struts.

18. An exercise device, comprising a substantially spherical housing having an opening through which the user's hand may be inserted, the housing having a pair of complementary hemispherical shells joining together along their respective circumferential edges about a common midplane, each shell having a relatively-thin outer wall formed with a concave inner surface, each shell further having an inner wall formed with a convex outer surface, such that the opening for the user's hand is disposed between the inner and outer walls, the opening being substantially tangentially of the housing, whereby a forceful grip is not required by the user, and whereby the necessity for employing the user's conjunctive adjoining muscles is substantially reduced, thereby substantially reducing the tendency to detract from the development of the user's targeted muscles, each shell including radially-projecting struts between the respective inner and outer walls, and further including cross ribs integrally joining the radially-projecting struts, thereby providing additional strength to each shell, a weight disposed between the complementary hemispherical shells and disposed substantially transversely of the common midplane between the shells, the weight having a pair of end portions, respectively, and means for securing each shell to a respective end portion of the weight, and the weight being substantially cylindrical and having an outer diameter, such that the outer diameter of the weight may be varied to vary the effective weight of the exercise device.

19. An exercise device comprising a housing including a pair of complementary mating portions having peripheral edges mating along a common midplane, a weight disposed between the mating housing portions substantially transversely of the common midplane therebetween, means for securing the housing portions and weight together to thereby form a unitary article, the housing having a substantially tangential opening formed therein to receive the user's hand, such that the palm of the user's hand substantially confronts and is cradled around the weight, and such that the back of the user's hand substantially confronts an inner walled surface of the housing, whereby a forceful grip by the user's hand on the weight is not necessary, and whereby the necessity for employing the user's conjunctive adjoining muscles is substantially reduced, thereof substantially reducing the tendency to detract from the development of the user's targeted muscle.

20. An exercise device having an opening formed therein through which the hand of the user may be inserted, the opening being defined by a pair of walls in the device and including an inner wall and an outer wall, whereby the user's hand is substantially curved around the inner wall and is disposed between the inner and outer walls, respectively, an internal wall within the device for limiting the insertion of the user's hand through the opening, and a weight means disposed substantially centrally of the device and within the inner wall thereof, such that a forceful grip of the user's hand on the weight means is not necessary, and such that the necessity for employing the user's conjunctive adjoining muscles is substantially reduced, thereby substantially reducing the tendency to detract from the development of the user's targeted muscle.

21. The exercise device of claim 20, wherein the inner wall has a convex outer surface, wherein the outer wall has a concave inner surface and is disposed radially of the inner wall, and wherein the internal wall comprises a radial wall joining the inner and outer walls beyond the opening in the device.

22. The exercise device of claim 20, wherein the device is substantially spherical, and wherein the opening is formed therein substantially tangentially thereof.

23. A substantially-spherical exercise device having a substantially tangential opening formed therein through which the hand of the user may be inserted, the opening being defined by a pair of walls in the device and including an inner wall and an outer wall disposed radially of the inner wall, the inner wall having a convex outer surface and the outer wall having a concave inner surface, whereby the user's hand is substantially curved around the inner wall and is disposed between the inner and outer walls, respectively, an internal radial wall within the device and joining the inner and outer walls for limiting the insertion of the user's hand through the tangential opening in the device, and a weight means disposed substantially centrally of the device and within the inner wall thereof, such that a forceful grip of the user's hand on the weight means is not necessary, and such that the necessity for employing the user's conjunctive adjoining muscles is substantially reduced, thereby substantially reducing the tendency to detract from the development of the user's targeted muscle.

24. The exercise device of claim 23, wherein the weight means comprises a substantially cylindrical weight.

25. The exercise device of claim 24, wherein the cylindrical weight has a pair of ends, each of which is secured to the device.

26. The exercise device of claim 25, wherein the cylindrical weight has an outer diameter, and wherein the outer diameter may be varied to vary the overall weight of the exercise device.

27. A method for forming an exercise device intended for strengthening a user's target muscle, comprising the steps of forming a pair of substantially hemispherical, relatively thin-walled housing portions, at least one of said housing portions having a cut-away portion and each of said housing portions having a peripheral edge and a diametrically-opposed portion; providing a weight means having a pair of opposed ends, providing a pair of cap screws; securing each opposed end of the weight means to a respective diametrically-opposed portions of each of the housing portions by one of the respective cap screws, so that each opposed end of the cylinder is supported thereby, and further so that the peripheral edges mate with one another, whereby the housing further has an opening formed therein substantially tangentially of the housing and communicating with the cut-away portion thereof.

28. The method of claim 27, wherein the peripheral edge of one of the housing portion is formed with a tongue and the peripheral edge of the other of the housing portions is formed with a groove sized to receive the tongue therein in a mating relationship, such that the peripheral edges of the housing portions mate with one another.

29. The method of claim 27, wherein each of the opposed ends of the weight means has a respective blind axial bore formed therein in which one of the respective cap screws is received and secured.

30. A method for forming an exercise device intended for strengthening a user's target muscle, comprising the steps of forming a pair of substantially hemispherical, relatively thin-walled housing portions, at least one of said housing portions having a cut-away portion and each of said housing portions having a peripheral edge and a diametrically-opposed portion; providing a weight means having a pair of opposed ends, providing a pair of cap screws; securing each opposed end of the weight means to a respective diametrically-opposed portions of each of the housing portions by one of the respective cap screws, so that each opposed end of the cylinder is supported thereby, and further so that the peripheral edges mate with one another, whereby the housing further has an opening formed therein substantially tangentially of the housing and communicating with the cut-away portion thereof, wherein the peripheral edge of one of the housing portion is formed having a tongue and the peripheral edge of the other of the housing portions is formed having a groove sized to receive the tongue therein in a mating relationship, such that the peripheral edges of the housing portions mate with one another, and wherein each of the opposed ends of the weight means are formed with a respective blind axial bore formed therein in which one of the respective cap screws is received and secured.

* * * * *